US006726428B1

(12) United States Patent
Canepari

(10) Patent No.: US 6,726,428 B1
(45) Date of Patent: Apr. 27, 2004

(54) SHELF HOOK LOADING TOOL

(76) Inventor: John A. Canepari, 3000 W. Polk, Chillicothe, MO (US) 64601

( * ) Notice: Subject to any disclaimer, the term of this patent is extended or adjusted under 35 U.S.C. 154(b) by 0 days.

(21) Appl. No.: 10/123,789

(22) Filed: Apr. 16, 2002

(51) Int. Cl.[7] ..... B65G 57/00

(52) U.S. Cl. ..... 414/27; 414/27; 211/57.1; 211/59.1

(58) Field of Search ..... 414/27; 211/57.1, 211/59.1

(56) References Cited

U.S. PATENT DOCUMENTS

| | | | | | |
|---|---|---|---|---|---|
| 808,864 | A | * | 1/1906 | McLaughlin | 402/67 |
| 868,286 | A | * | 10/1907 | Munday | 211/57.1 |
| 1,184,735 | A | * | 5/1916 | Freid | 402/7 |
| 3,136,519 | A | * | 6/1964 | Spriggle | 248/230.8 |
| 3,402,435 | A | * | 9/1968 | Merser | 24/16 PB |
| 3,501,015 | A | * | 3/1970 | Behles | 211/49.1 |
| 3,912,178 | A | * | 10/1975 | Ballin | 15/204 |
| 4,076,126 | A | * | 2/1978 | Gilmour | 211/59.1 |
| 4,143,772 | A | * | 3/1979 | Bona | 211/59.1 |
| 4,474,300 | A | * | 10/1984 | Entis | 211/57.1 |
| 4,798,297 | A | * | 1/1989 | Weiss et al. | 211/65 |
| 5,388,709 | A | * | 2/1995 | Adams | 211/70.6 |
| 5,901,860 | A | * | 5/1999 | Nowicki | 211/59.1 |
| 6,446,819 | B1 | * | 9/2002 | Mattesky | 211/57.1 |

OTHER PUBLICATIONS

Mattesky, Henry, Method for Loading Merchandise Onto Pegboard Display, Nov. 14, 2002, U.S. patent application Publication, US 2002/0166824 A1.*

* cited by examiner

*Primary Examiner*—Janice L. Krizek
(74) *Attorney, Agent, or Firm*—Chase Law Firm, L.C.

(57) ABSTRACT

A shelf hook loading tool for loading multiple articles onto a display or shelf hook. The device includes an angled or flexible tubular member for supporting multiple articles of merchandise, a means for securing the merchandise to the tool, and a mounting means for facilitating insertion of the tool onto a shelf hook. Once the tool is inserted onto a shelf hook, merchandise can be readily loaded by sliding it off the tool and onto the shelf hook. The tool is then removed from the shelf hook for reuse or disposal.

13 Claims, 4 Drawing Sheets

Fig. 6
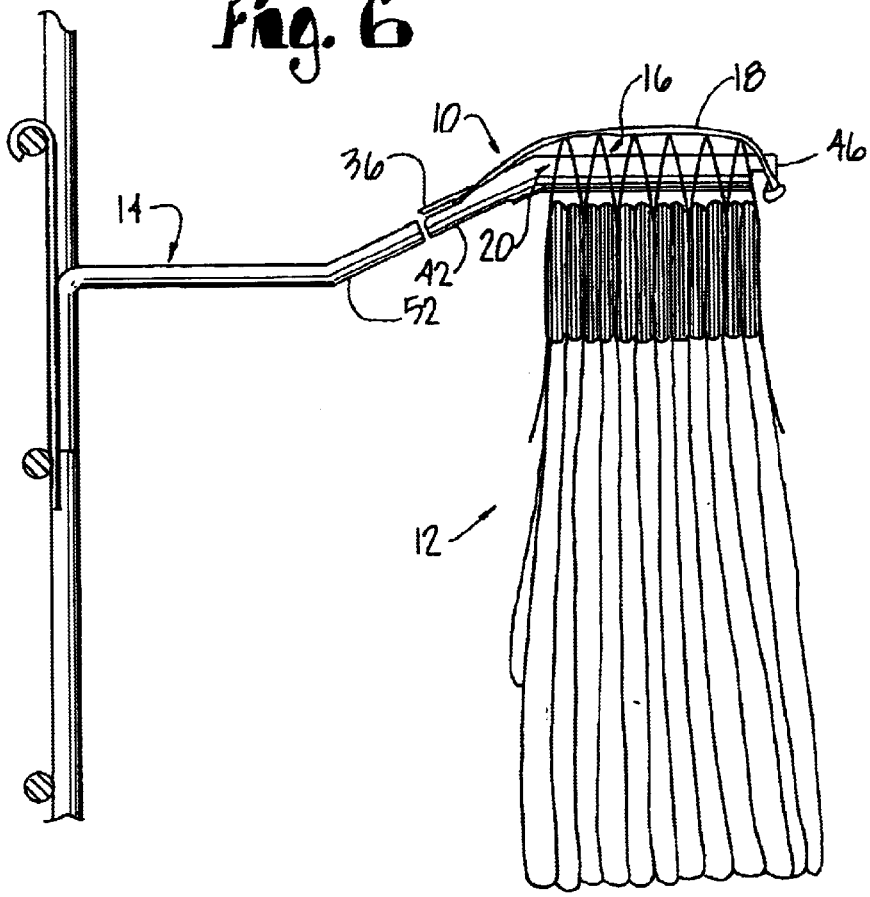
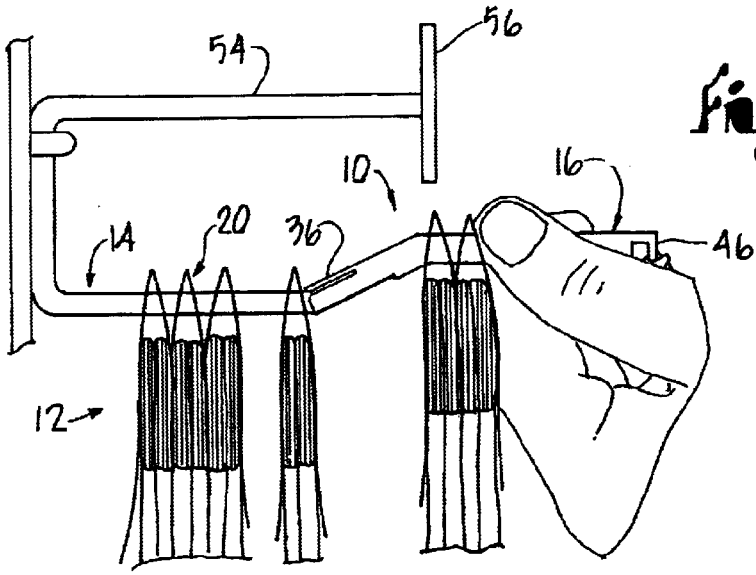
Fig. 7

SHELF HOOK LOADING TOOL

FIELD OF THE INVENTION

The present invention relates to shelf hooks for displaying merchandise and more particularly to a method and apparatus for loading merchandise onto shelf hooks.

BACKGROUND OF THE INVENTION

Shelf hooks, of the type normally used to display products or merchandise on store racks, are a popular means of storing multiple articles in a relatively small space and in a manner that allows purchasers to readily access a product without having to move or disturb other products or the display arrangement itself.

At present, there are a variety of shelf hooks used for displaying articles but most share common characteristics of having a horizontally disposed rod attached at one end to a vertical support surface or wall, with the other end of the rod projecting outward to receive the displayed products. Articles to be displayed are typically loaded onto this outward end of the shelf hook and then pushed along the shelf hook rod toward the support wall in order to make room for loading of additional merchandise.

In order to help retain articles on the shelf hook, the outward end of the rod often includes a bend directed in an upward, outward angle. While presumably adequate for its intended function, this bend or hook often complicates loading the shelf hook with merchandise. Threading the shelf hook through multiple product tags can be cumbersome because the bend at the end of the rod tends to catch or snag on individual tags. Often, merchandise is simply loaded one unit at a time to overcome this difficulty. In addition, when removing shipping packaging to access merchandise for loading, individual units often become disarrayed and are not packaged in a way that lends itself to rapid loading of multiple units on a shelf hook.

Therefore, there exists a need for a method and apparatus for loading multiple products onto a shelf hook in an easy and rapid fashion, preferably using a device capable of being incorporated into the product packaging prior to shipping to the display destination.

SUMMARY OF THE INVENTION

A shelf hook loading tool in accordance with the present invention providing an elongated, tubular body adapted to receive a product or products for loading onto a shelf hook. The device includes a head portion, a mounting member facilitating the insertion of the device onto a shelf hook, and a rear portion extending angularly from the head portion. A tail member is attached to the device, preferably near the terminus of the rear portion and is adapted to be selectively secured to and removed from the head portion. The head portion can include a means, such as a tab or slit(s), for attaching the tail member to the head position.

The following description, taken in connection with the accompanying drawings, sets forth by way of illustration and example, a now preferred embodiment of this invention, among others.

BRIEF DESCRIPTION OF THE DRAWINGS

FIG. 6 is a side view of the loading tool, showing the tool positioned to be inserted over the end of a shelf hook;

FIG. 7 is a side view of the loading tool showing the gloves being removed from the loading tool onto the shelf hook;

DETAILED DESCRIPTION

Figure 5:
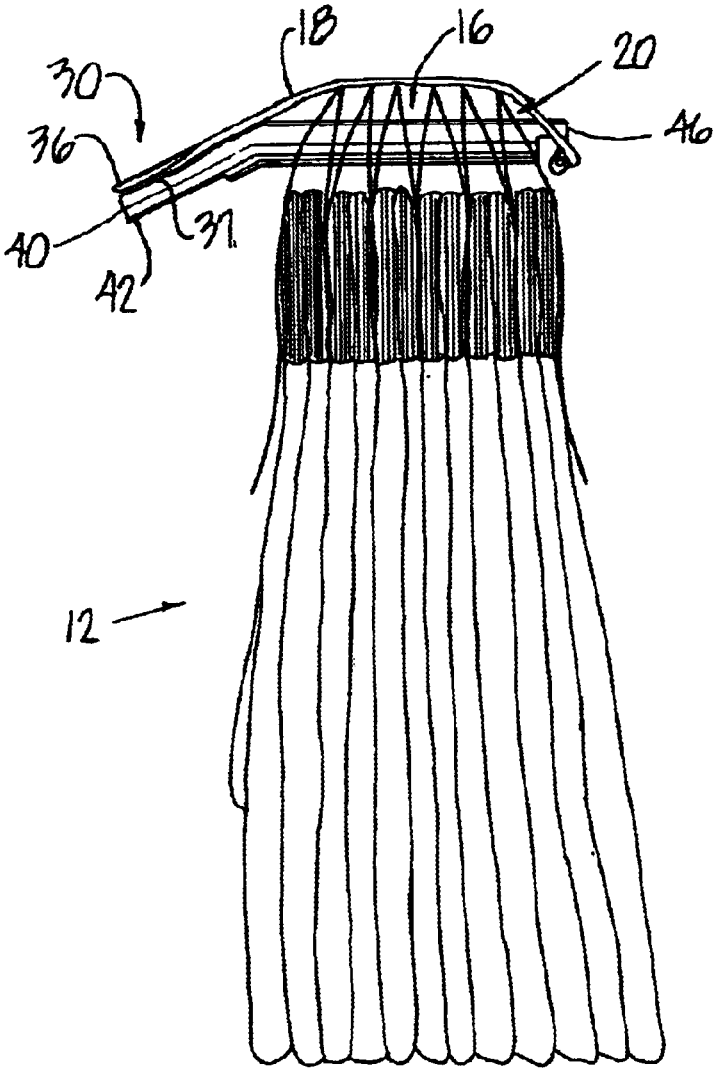
FIG. 5 is a side view showing work gloves mounted on the loading tool, with the tool's tail securing the gloves thereon.

A shelf hook loading tool 10, in accordance with the present invention, is shown in FIGS. 5–7 loading a set of gloves 12 onto a shelf hook 14 for display and sale. The tool 10 includes a body 16 and a tail 18. As seen in FIGS. 5–7, the labels or tags 20 of each of the gloves 12 are loaded onto the body 16 and held thereon by the tail 18 until removal is desired, discussed below in more detail. Although the figures depict the tool 10 being used with a set of gloves 12, the tool 10 may be used with any product mountable on a shelf hook.

As shown in FIGS. 1–7, the body 16 is formed of metal; however, the body 16 can be formed of any other relatively rigid, load bearing material, such as plastic. As shown in detail in FIGS. 1–4, the body 16 is an elongated, tubular member having a through passageway 22 extending through the entire length of the body 16. The passageway's diameter is adapted to allow the body 16 to fit around the shelf hook 14, as seen in FIG. 7. In other words, passageway 22 has a diameter larger than the shelf hook 14. The outer diameter of the body 16 is adapted to receive labels/hang tags 20 thereover, as shown in FIGS. 5–7. In other words, the diameter of the body 16 is smaller than the label openings. The body 16 includes a head portion 30, a neck portion 32 and a rear portion 34 which are integrally and unitarily connected to form the elongated, tubular body 16.

The head or first end portion 30 includes a first free end 40 of the body 16. The head 30 further includes a narrow, elongated opening or slot 42. The slot 42 extends from the free end 40 and terminates adjacent the junction between the head 30 and neck 32. As shown and described herein for use with the gloves 12, the head 30 is approximately one inch long and the slot 42 is approximately ¾ inch long and ¼ inch wide. The head 30 may include additional structure such as a slit or slits 37, 38 or tab 36 to facilitate removably securing the tail 18 to the head 30.

The neck 32 extends between the head 30 and the rear portion 34. The neck 32 presents a bend in the body 16 so that the head portion 30 extends angularly from the rear portion 34.

The rear portion 34 extends from the neck to a second free end 46 of the body 16. The rear portion 34 presents a length that is adapted to accommodate the set of gloves 12 for mounting to the shelf hook 14, as shown in FIGS. 5–7. This length can be changed as necessary depending on the type of item and/or number of items to be mounted. Generally, the rear portion 34 will have a substantially greater length than the head portion 30 due to their different functions. In the embodiment shown in FIGS. 1–7, the rear portion 34 includes a slit 48 which is formed adjacent to but is spaced from the second free end 46 in alignment with the slot 42. The tail 18 of the tool 10 is thereby secured to the body 16 through the slit 48.

Figure 1:
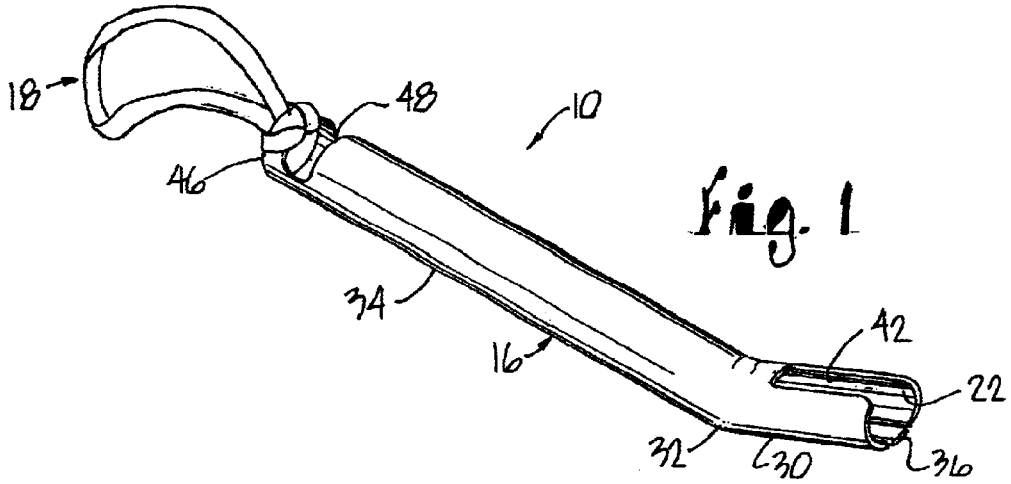
FIG. 1 is a perspective view of a shelf hook loading tool in accordance with the present invention.
Figure 2:
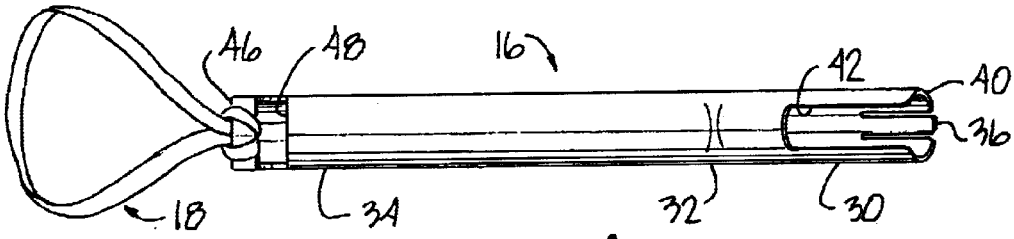
FIG. 2 is a top plan view of the shelf hook loading tool of FIG. 1.
Figure 3:
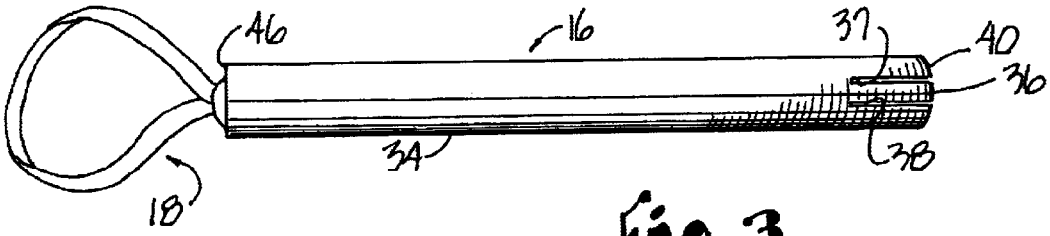
FIG. 3 is a bottom plan view of the shelf hook loading tool of FIG. 1.
Figure 4:
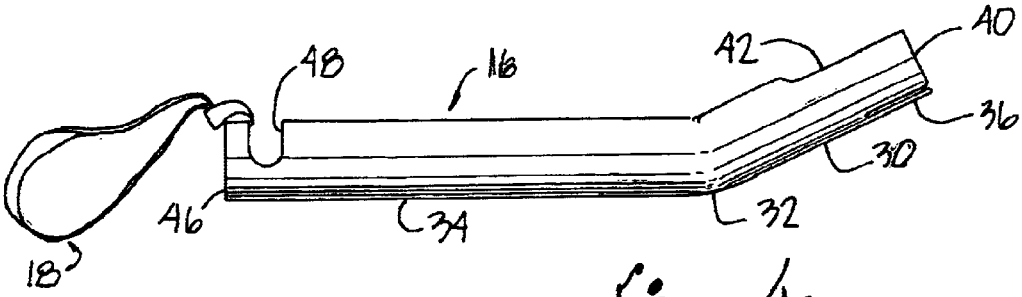
FIG. 4 is a side elevation of the shelf hook loading tool of FIG. 1.

As shown in FIGS. 1–7, the tail 18 is a stretchable and flexibly resilient loop, like a rubber or elastic band. The tail 18 attaches to the second free end 46 of the rear portion 34, through the slit 48 by inserting it into the passageway 22, up through the slit 48 and over itself, as seen in FIGS. 1, 2 and 4. Of course, the tail 18 could be secured to the second free end 46 by any other suitable means such as adhesive. If secured in some alternative way, the slit 48 may be unnecessary.

In use, the first free end 40 of the body 16 is inserted through holes (not shown) formed in the labels or tags 20 of the gloves 12 and the tail 18 is stretched over the top of the labels 20 and secured to the head portion 30 of the body 16, as shown in FIG. 5. The tail 18 thus prevents the set of gloves 12 from sliding or slipping off of the tool before the gloves 12 are loaded onto the shelf hook 14. Typically, the gloves 12 are substantially loaded onto the rear portion 34 of the body 16.

As shown in FIGS. 5 and 6, the tail 18 may be secured by engagement with tab 36 or slit(s) 37, 38 formed in the end of the head 30. Alternatively, the tail 18 may be secured to the head 30 by simply looping the tail 18 over and in engagement with the end 40 of the head 30. Once secured, the gloves 12 or other merchandise can be packaged, stored and shipped to the destination for display on a shelf hook 14.

The set of gloves 12 which have been loaded onto the tool 10, as in FIG. 5, are now ready for loading onto the shelf hook 14, as seen in FIGS. 6 and 7. The tool 10 is first positioned with the head 30 directed toward the shelf hook 14 as shown in FIG. 6. The body 16 at head portion 30, is then inserted over the end of the shelf hook 14 as shown in FIG. 7.

In general and as shown, shelf hooks include an end portion 52 that angles upwardly. This end portion 52 thereby prevents any products mounted onto the shelf hook from easily falling off. The angle of the head portion 30 and the slot 42 formed therein now cooperate to facilitate the insertion of the first free end 40 of the tool 10 over the shelf hook end 52.

However, shelf hook configurations vary. Slot 42 allows the tool 10 to be used with different types of shelf hooks 14. For instance, in FIG. 7, shelf hook 14 includes a top flange 54 that terminates in a price display 56. This price display 56, which is typically spaced only a small distance above the shelf hook end 52, can make loading products such as the gloves 12, thereon more difficult. However, the slot 42 facilitates the mounting of the gloves 12 onto the shelf hook by allowing the tool 10, particularly the rear portion 34 of the tool, to be maintained in a horizontal disposition while gloves 12 are mounted.

After the first free end 40 is inserted over the shelf hook end 52, the gloves 12 are simply pushed off of the rear portion 34, slid down the neck portion 32 and head portion 30 and onto the shelf hook 14, as shown in FIG. 7. By sliding the gloves 12 off of the body 16 of the tool 10, the tail 18 is disengaged from the tab 36 or slit(s) 37, 38 or free end 40 and the tail 18 is then left to hang from the second free end 46 of the rear portion 34. For example, when the gloves 12 are moved from the tool 10 to the shelf hook 14, the force applied causes the leading label to engage the tail 14 causing it to slide out of the slits 37, 38 thereby releasing the gloves 12 from the tool 10.

Figure 8:
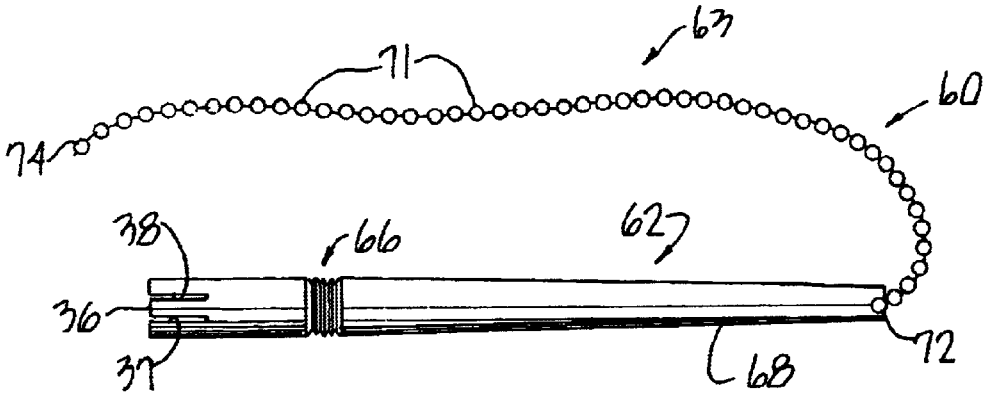
FIG. 8 is a top plan view of a second embodiment of a shelf hook loading tool in accordance with the present invention.
Figure 9:
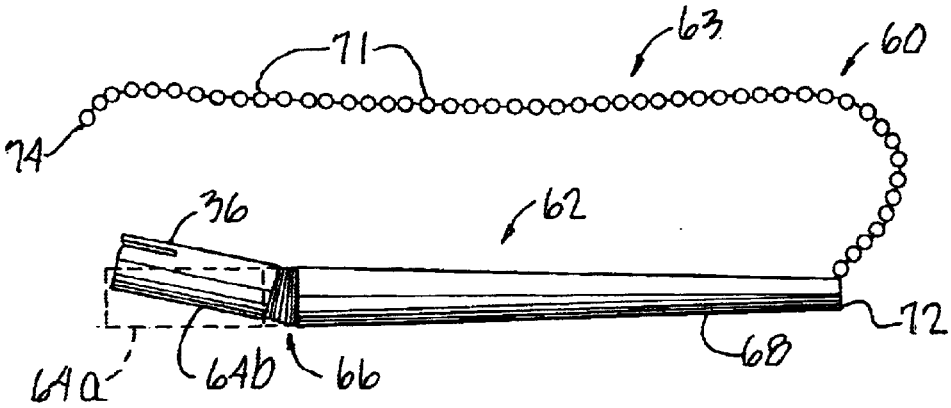
FIG. 9 is a side view of the loading tool of FIG. 8 and shows the action of the neck which pivots the head portion of the tool.

FIGS. 8 and 9 show a second embodiment 60 of the loading tool in accordance with the present invention. In many respects, the second embodiment is identical to the embodiment shown in FIGS. 1–7. Accordingly, primarily the differences will be discussed.

The second embodiment 60 includes a body 62 that is formed of rigid plastic except that the neck portion 66 is flexibly resilient and accordion-like. As shown in FIG. 9, the neck 66 pivots the head portion 64, wherein the head portion 64 and the rear portion 68 are aligned between a straight position, and an angled or bent position. The rear portion 68 of this second embodiment, unlike the first embodiment, does not have a slit. The tail 63 is a flexible strap member having spaced apart beads 71 thereon. The tail 63 may be secured at or adjacent the free end 72 of the rear portion 68 by any type of suitable adhesive. Alternatively, the tail 63 may be formed as a contiguous extension of the body 62 itself. This tail 63 thus includes a free end 74 which is inserted into a slit 37 or 38 and secured by any one of the beads 71 of the tail 63 to hold any product mounted onto the body 62, similar to the tail 18 of the first embodiment.

Figure 10:
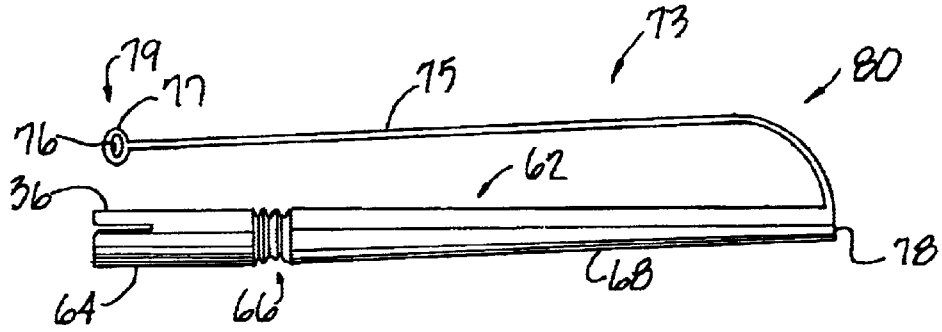
FIG. 10 is a side view of a third embodiment of a shelf hook loading tool in accordance with the present invention.

FIG. 10 shows a third embodiment 80 of the loading tool in accordance with the present invention. The third embodiment is identical in many respects to the first (FIGS. 1–7) and second (FIGS. 8, 9) embodiments. Accordingly, primarily the differences will be discussed. The third embodiment 80 preferably includes a body 62, neck 66, head 64, rear 68, tab 36, and slits 36 and 37 substantially similar to those of the second embodiment shown in FIGS. 8 and 9 and described above. The tail 73 includes a flexible strap secured to, or contigous with, the free end 78 of the rear portion 68. Preferably, the tool 80 is molded or otherwise produced as a single piece.

The tail 73 has a free end 79. Typically, the free end 79 includes a structure such as a loop 77 that engages with a tab 36 or other suitable structure to removably secure the tail 73 to the head 64 to hold any product mounted onto the body 62 of the tool 80, similar to the tail 18 of the first embodiment.

It is to be understood that while certain forms of this invention have been illustrated and described, it is not limited thereto except insofar as such limitations are included in the following claims and allowable equivalents thereof.

Having thus described the invention, what is claimed as new and desired to be secured by Letters Patent is as follows:

1. A shelf hook loading tool, comprising:

an elongated body having a tubular head portion and an opposing rear portion, said body adapted to receive a product for loading onto a shelf hook;

a tail member attached to said rear portion, adapted to be selectively secured to and removed from said head portion;

whereby said tubular head portion is adapted for receiving a shelf hook therein.

2. A shelf hook loading tool as claimed in claim 1 wherein said head portion and said rear portion are angularly disposed.

3. A shelf hook loading tool as claimed in claim 1 wherein said head portion includes a slot formed therein.

4. A shelf hook loading tool as claimed in claim 1 wherein said head portion includes a pivotable neck.

5. A shelf hook loading tool as claimed in claim 1 wherein said tail member is a flexible, resilient loop, attached to said rear portion and adapted to removably secure to said head portion.

6. A shelf hook loading tool as claimed in claim 1 wherein said tail member is a beaded strap attached to said rear portion and adapted to removably secure to said head portion.

7. A shelf hook loading tool as claimed in claim 1 wherein said tail member is a flexible strap including a loop adapted to engage a tab formed in a free end of said head portion.

8. A shelf hook loading tool as claimed in claim 1 wherein said head portion includes a means for attaching said tail member to said head portion.

9. A shelf hook loading tool as claimed in claim 8 wherein said means for attaching said tail member to said head portion comprises a slit.

10. A shelf hook loading tool as claimed in claim 8 wherein said means for attaching said tail member to said head portion comprises a pair of slits presenting a tab therebetween.

11. A shelf hook loading tool, comprising:

an elongated body having a tubular head portion and an opposing rear portion, said body adapted to receive a product for loading onto a shelf hook, said head portion and said rear portion being angularly disposed;

a flexible, resilient loop attached to said rear portion, adapted to be selectively secured to said head portion; and a throughbore extending through a length of said head portion and a slot formed in said head portion, for inserting said tool onto a shelf hook.

12. A shelf hook loading tool as claimed in claim 11 wherein said head portion includes a means for attaching said loop to said head portion.

13. A shelf hook loading tool as claimed in claim 12 wherein said means for attaching said loop to said head portion comprises a pair of slits presenting a tab therebetween.

* * * * *